US005735315A

United States Patent [19]

Petsche et al.

[11] Patent Number: 5,735,315

[45] Date of Patent: Apr. 7, 1998

[54] WIRE LOOM DOBBY

[75] Inventors: Arnold E. Petsche; Nasser Ghariban; Mark A. Goodman, all of Arlington, Tex.

[73] Assignee: A.E. Petsche Company, Inc., Arlington, Tex.

[21] Appl. No.: 712,450

[22] Filed: Sep. 11, 1996

[51] Int. Cl.[6] ..... D03C 1/06

[52] U.S. Cl. ..... 139/68; 139/71

[58] Field of Search ..... 139/68, 69, 71, 139/72, 66 R

[56] References Cited

U.S. PATENT DOCUMENTS

| | | | |
|---|---|---|---|
| 3,984,622 | 10/1976 | Ross . | |
| 4,461,325 | 7/1984 | Palau et al. | 139/76 |
| 4,463,323 | 7/1984 | Piper . | |
| 4,504,696 | 3/1985 | Piper . | |
| 4,527,135 | 7/1985 | Piper . | |
| 4,527,597 | 7/1985 | Yoshida et al. . | |
| 4,559,411 | 12/1985 | Piper . | |
| 4,566,499 | 1/1986 | Kitagawa et al. . | |
| 4,712,298 | 12/1987 | Mondor, III . | |
| 4,746,769 | 5/1988 | Piper . | |
| 4,850,399 | 7/1989 | Linka et al. . | |
| 4,949,760 | 8/1990 | Wilson et al. . | |
| 5,070,913 | 12/1991 | Palmer | 139/319 |
| 5,148,585 | 9/1992 | Jaeger . | |
| 5,246,039 | 9/1993 | Fredriksson . | |
| 5,360,038 | 11/1994 | Sano . | |
| 5,365,979 | 11/1994 | Yoshida | 139/66 R |
| 5,390,709 | 2/1995 | Martonffy . | |

FOREIGN PATENT DOCUMENTS

| | | | |
|---|---|---|---|
| 62-62944 | 3/1987 | Japan | 139/71 |
| 62-263343 | 11/1987 | Japan | 139/71 |

*Primary Examiner*—Andy Falik

*Attorney, Agent, or Firm*—James E. Bradley

[57] ABSTRACT

Attached to a dobby for use in a loom is an actuator which is, in turn, attached to a first finger and a second finger to move them in unison in a cycle. The first and second fingers control the position of an upper hook and a lower hook. These hooks, when engaged by a knife, will raise a frame. During the first half of a cycle, the actuator positions both fingers in either an upper or lower position. In the second half of the cycle, the actuator positions the fingers in either the upper or lower position.

9 Claims, 12 Drawing Sheets

POS. 1
POS. 2
318
320
310
314
316
308

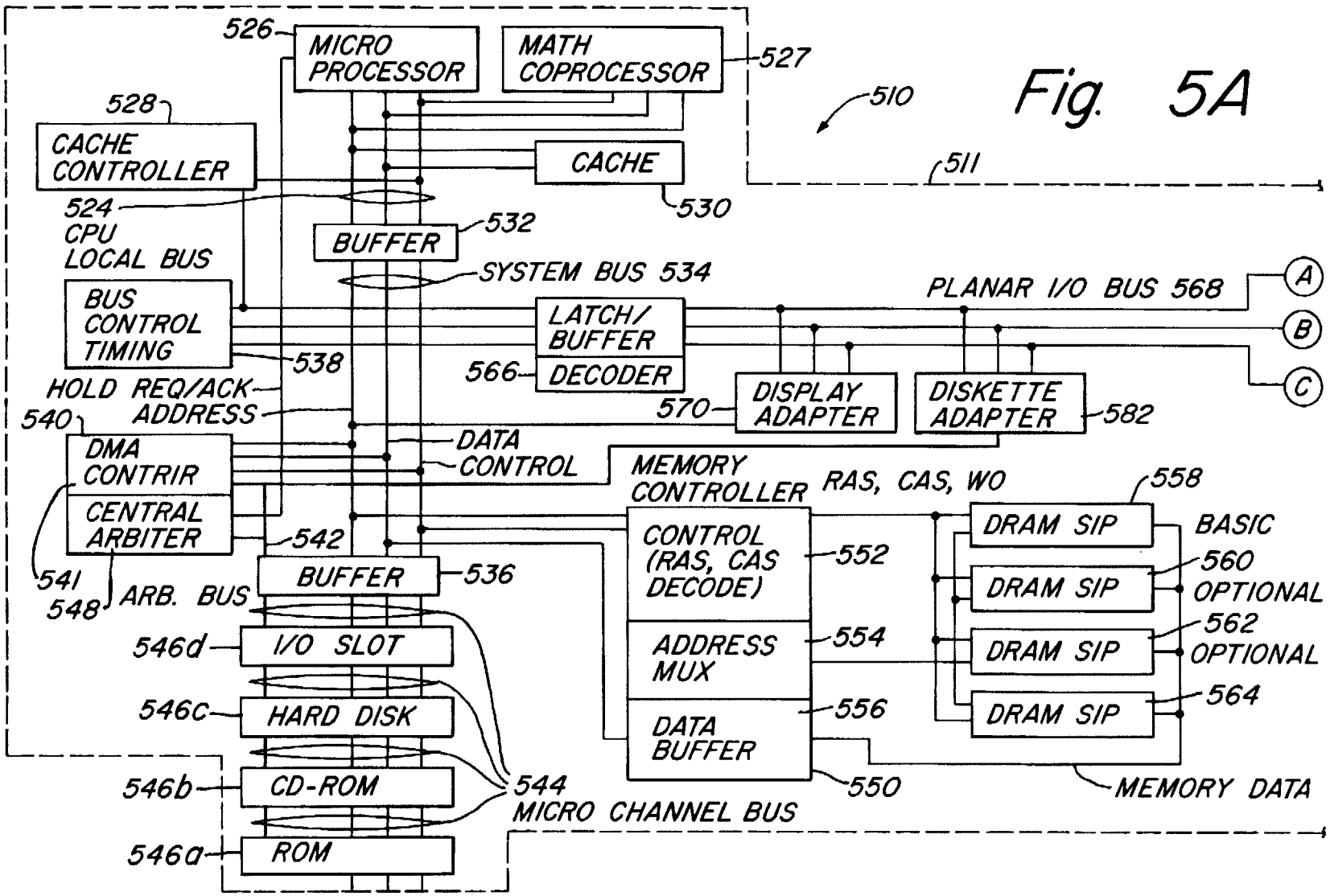
Fig. 5A
510
511
527
MATH COPROCESSOR
530
CACHE
MICRO PROCESSOR
526
532
BUFFER
SYSTEM BUS 534
528
CACHE CONTROLLER
524
CPU LOCAL BUS
LATCH/ BUFFER
DECODER
566
538
BUS CONTROL TIMING
HOLD REQ/ACK
ADDRESS
PLANAR I/O BUS 568
A
B
C
DISPLAY ADAPTER
570
DISKETTE ADAPTER
582
DATA
CONTROL
DMA CONTRIR
540
CENTRAL ARBITER
541
548
ARB. BUS
MEMORY CONTROLLER
RAS, CAS, WO
552
CONTROL (RAS, CAS DECODE)
554
ADDRESS MUX
556
DATA BUFFER
550
542
BUFFER
536
558
DRAM SIP
DRAM SIP
DRAM SIP
DRAM SIP
BASIC
560
OPTIONAL
562
OPTIONAL
564
MEMORY DATA
544
MICRO CHANNEL BUS
I/O SLOT
HARD DISK
CD-ROM
ROM
546d
546c
546b
546a

WIRE LOOM DOBBY

BACKGROUND OF THE INVENTION

1. Technical Field

The present invention relates generally to weaving looms, and in particular, to an improved dobby for use with looms which weave a series of insulated wires into flat, multi-conductor cables. Also, the present invention discloses a method for controlling the operation of the improved dobby.

2. Description of the Related Art

In one form or another, looms for weaving thread into cloth have been in existence for hundreds of years. More recently, it was discovered that looms originally designed for use in the textile industry could be modified to weave wire into cables. These cables are often flat in appearance, and are composed of several individual wires that have been bound together with a Kevlar thread or the like. These flat, multi-conductor cables have improved crosstalk and conductance characteristics in comparison with previous forms of multi-conductor cables. These cables have many industrial and military applications.

Previous wire weaving looms created these flat cables according to a series of control devices known as peg boards. In one form, peg boards are rectangular strips of wood with a series of holes through them. These holes are designed to receive metal studs. The locations of the metal studs within the various holes of the peg board determine how the wires are weaved for one cycle of the weaving process. In practice, long chains of peg boards are linked together, and for each cycle, the wire weaving loom will examine a new peg board. In this manner, a large number of individual wires can be weaved into a flat cable having a specified type of weave.

A user needs to specify a particular weave in order to provide for drop outs. Drop outs refer to wires within the cable which, at some point, are removed from the cable as a whole and are routed elsewhere. For example, in a thirty foot cable having fifteen individual conductors, a design may specify that five of the conductors are to branch out from the main cable ten feet from one end of the cable. When weaving a cable according to the above design criteria, one must alter the weave ten feet from the beginning of the cable in order to provide for the drop outs to be separated from the main cable.

As stated above, previous looms required that long series of peg boards be fed into the loom in order to specify the weaving pattern. Providing these long series of peg boards, however, is a very arduous and time consuming process. For instance, the metal studs within each peg board must be placed by hand. As such, there are many chances for human error to enter into this process. Also, storing a series of programmed peg boards for future use is costly because of the space requirements needed.

Therefore, it would be advantageous to have a data processing system which could control the weaving of the flat, multi-conductor wire cable. This data processing system would make it very easy to program complex series of weaves.

It would also be advantageous to have an improved wire weaving loom. This loom would be able to accept commands from the data processing system mentioned above and weave patterns as specified by the data processing system. Also, the improvements necessary to transform a standard loom, which uses peg boards, into a loom which can accept commands from a data processing system should be easy to make and inexpensive.

SUMMARY OF THE INVENTION

It is therefore on object of the present invention to provide a loom for weaving wire according to commands from a data processing system.

It is another object of the present invention to provide for a data processing system to control the wire weaving loom. This data processing system should be easy to program and operate.

Another object of the present invention is to allow for the conversion of older looms into looms which perform according to the current invention.

Accordingly, a dobby for use with a loom is provided. Attached to this dobby is an actuator. This actuator is, in turn, attached to a first finger and a second finger. The first and second fingers control the position of an upper hook and a lower hook. These hooks, when extended by a knife, will raise a frame. During the first half of a cycle, the actuator positions the first finger so that it moves the lower hook into engagement with a lower knife. The lower knife will extend the hook and raise the frame during the first half of the cycle. In the second half of the cycle, the actuator positions the second finger so that it moves the upper hook into engagement with an upper knife. The upper knife then extends the hook so that the frame is raised during the second half of the cycle.

A data processing system for controlling a pattern weaved by the loom is also provided. This data processing system comprises a bus, a central processing unit, and a data processing system memory. The data processing system memory is connected to the central processing unit via the bus. Within the data processing system memory is a weave control mechanism for specifying the pattern weaved by the loom. Initially, the weave control mechanism displays a peg board representation having selectable areas corresponding to peg holes. The user may select various ones of these holes, thereby programming a pattern to be weaved during one half cycle. After selecting some of these holes, the data processing system causes the loom to raise a frame corresponding with the selected areas.

The above as well as additional objects, features, and advantages of the present invention will become apparent in the following detailed written description.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE PREFERRED EMBODIMENT

Figure 1:
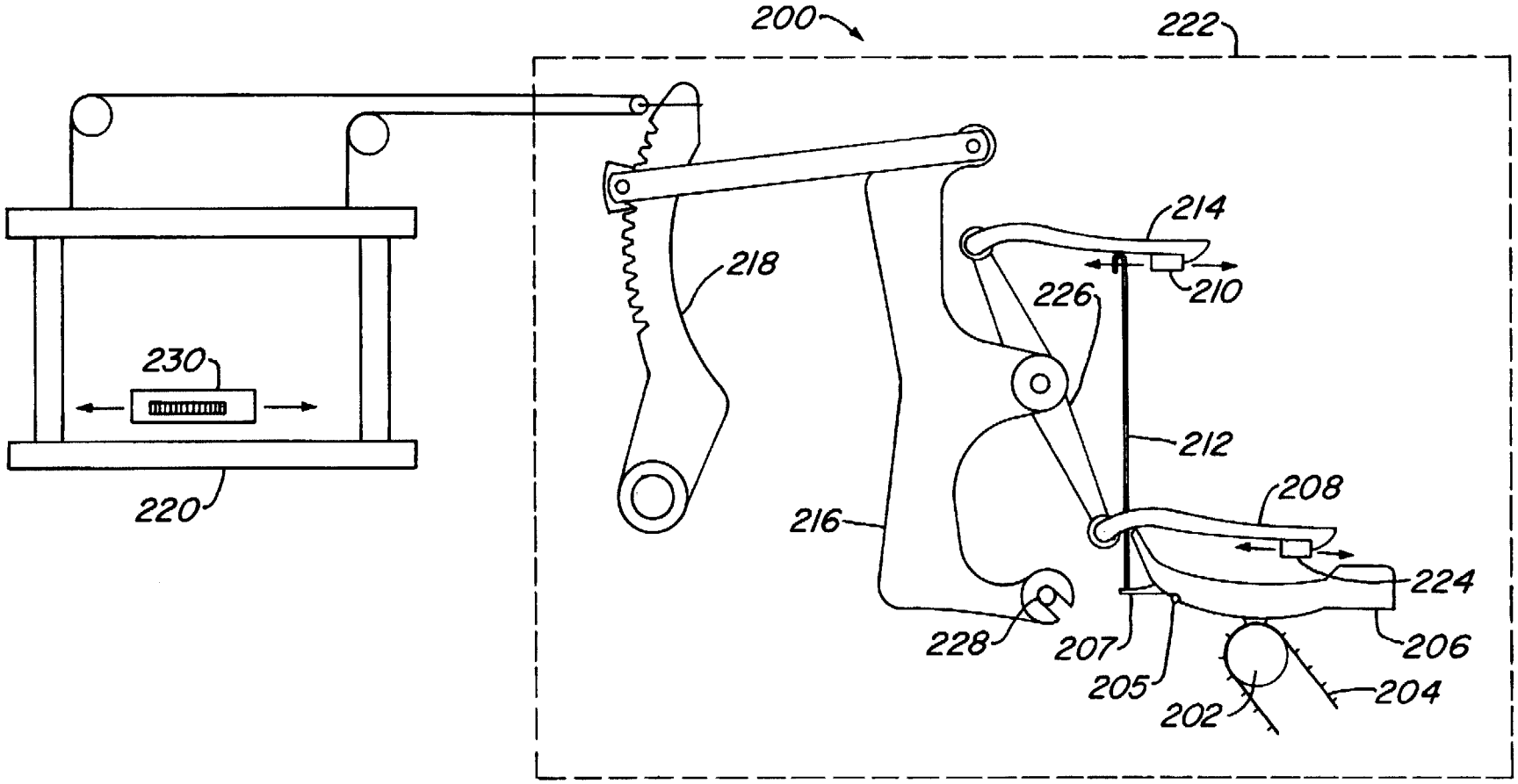
Fig. 1 (PRIOR ART)
FIG. 1 depicts a prior art dobby that can be modified according to the present invention.

With reference now to FIG. 1, there is depicted a cross-sectional view of a prior art dobby and its connection to a frame. Dobby 222 is comprised of several elements which work together to selectively raise a plurality of frames. For clarity, only frame 220 is shown in FIG. 1. Chain cylinder 202 and peg board chain 204 provide the control mechanism for dobby 222. Peg board chain 204 is comprised of a series of peg boards. In one form, these peg boards contain two parallel rows of holes. These holes are designed to receive metal studs. The placement of these studs within the holes dictates what pattern will be weaved by the loom. One peg board will be processed for each weaving cycle. After the cycle is complete, chain cylinder 202 will rotate to advance a new peg board which will dictate how the next weaving cycle is to be performed.

Chain cylinder 204 controls the pattern weaved by the loom by selectively raising fingers 206 and 207. During operation, chain cylinder 202 will rotate a peg board within peg board chain 204 directly under fingers 206 and 207. This peg board will have a hole which aligns with finger 206 and a hole which aligns with finger 207. If metal studs are present in the holes which correspond with fingers 206 and 207, these metal studs will contact fingers 206 and 207, thereby rotating them about point 205. This rotation will lower the ends of the fingers which are in contact with the hooks.

The lowering of the portion of a finger which is in contact with a hook results in the hook associated with the finger being lowered. In FIG. 1, finger 206 is in contact with hook 208. Also, finger 207 (which is directly behind finger 206) is connected to hook 214 by needle 212. As shown in FIG. 1, both hook 214 and 208 are in the lowered position and are in contact with knives 210 and 224, respectively. If hooks 214 and 208 were not in the lowered position as shown, they would not come in contact with knives 210 and 224.

When a finger rotates about point 205, the hook associated with that finger is lowered and the knife associated with that hook will eventually come into contact with the hook. At this point, the hook will move outward (to the right in the drawing) along with the knife, with the resulting motion being that dobby jack 216 pulls on frame jack 218. Frame jack 218 is connected to frame 220 by a cable. This movement by frame jack 218 results in frame 220 being raised for one-half cycle. Attached to frame 220 is at least one wire which is being woven into the multi-conductor cable. This wire is alternately raised and lowered by frame 220. When a frame is raised, shuttle 230 passes under the wire for that half cycle. Likewise, when a frame is lowered, the shuttle will pass over the wire.

Knives 210 and 224 move inward and outward as indicated by the arrows. Knives 210 and 224 operate in a reciprocal fashion. While knife 210 is moving inward, knife 224 is moving outward. A movement of one of the knives 210, 224 from its inward position to its outward position constitutes one half of a weaving cycle.

Hooks 214 and 224 are pivotally connected to each other on their inner ends by link 226, which in turn is pivotally connected to dobby jack 216. Dobby jack 216 pivots about a pivot point 228 when pulled outward by link 226. If both hook 208 and 214 are in the lowered position, frame 220 stays up for a full cycle.

Shuttle 230 is provided to bind individual wires into a flat multi-conductor cable. As the frames of the loom are alternately raised and lowered, shuttle 230 is moving back and forth (as noted by the arrows) each half cycle. Attached to shuttle 230 is a spool of Kevlar thread or the like. As shuttle 230 moves back and forth, the thread unwinds and binds the individual wires together into a cable.

Figure 2:
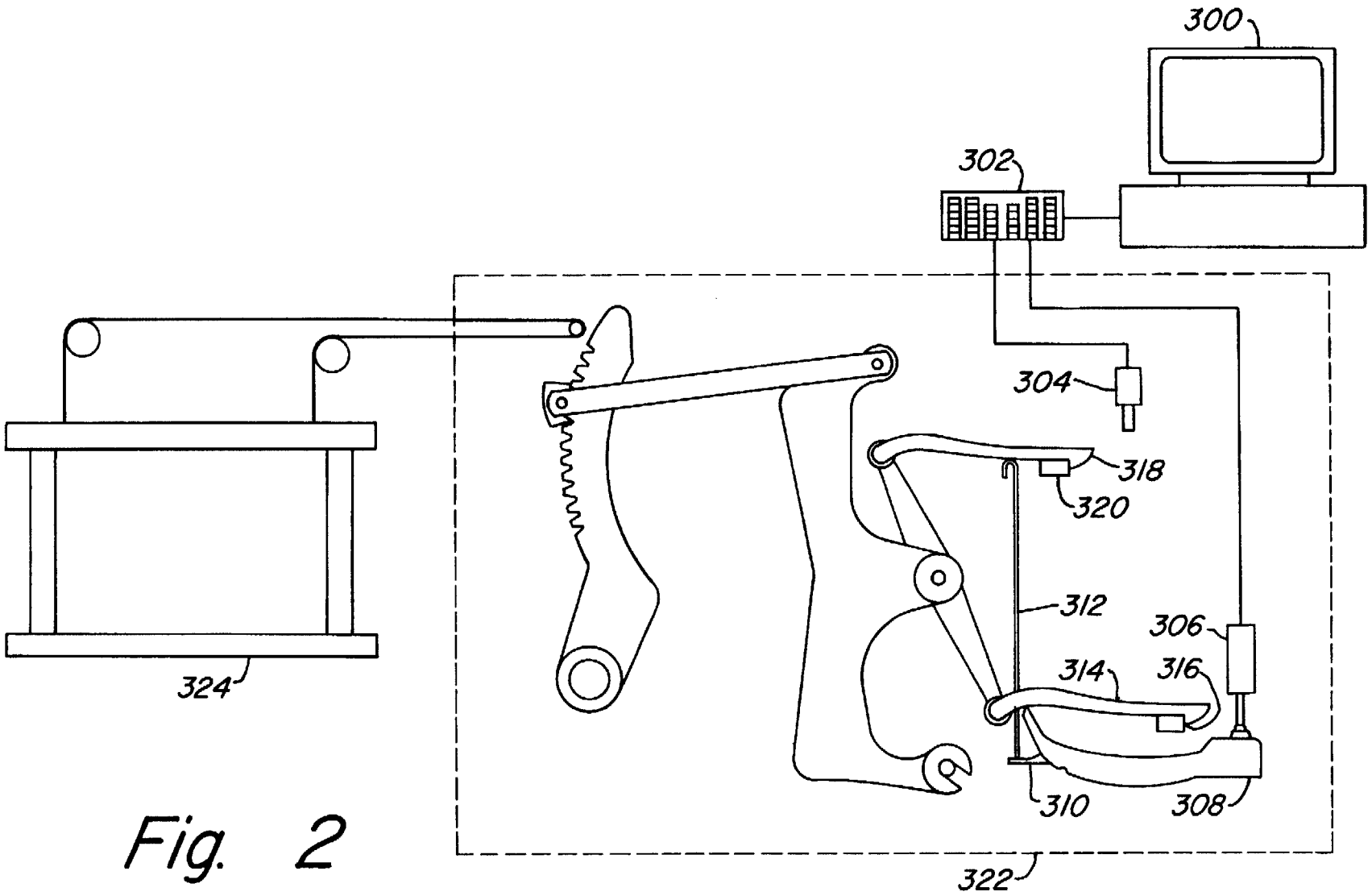
FIG. 2 depicts a dobby according to the present invention.

With reference now to FIG. 2, there is shown an improved dobby according to the present invention and a data processing system for controlling the operations of the improved dobby. Central to improved dobby 322 is solenoid 306. Solenoid 306 is preferably an electrical solenoid, but, pneumatic type actuators may also be used. Solenoid 306 is connected to both finger 310 and finger 308. Since solenoid 306 is connected to both fingers 310 and 308, the raising of one finger by the solenoid will necessarily raise the other finger. Thus, fingers 310 and 308 will operate in unison. Being connected to both fingers allows solenoid 306 to control hook 318 and hook 314 during the same cycle.

Solenoid 306 can control both hook 318 and 314 due to the fact that once a knife has engaged a hook, no further action by the finger that controls the hook is necessary to keep the hook engaged with the knife. For instance, in FIG. 2, hook 318 is in its inward position and is just beginning to be engaged by knife 320, while hook 314 has been previously engaged by knife 316 and has been pulled to is outward position. When the knives are in these positions, solenoid 306 can disregard the positioning of hook 314 and is free to position hook 318 is accordance with commands from data processing system 300. Also, assuming hook 314 had not been engaged by knife 316, the lowering of hook 318 (and as a consequence the lowering of hook 314) would not make a difference to hook 314 because knife 316 would already be outward of the point by which it could engage hook 314. In this manner, solenoid 306 controls both hook 318 and hook 314. Once the hooks have been engaged by a knife, the raising and lowering of frame 324 is accomplished in the same manner as the prior art. Consequently, even though fingers 308 and 310 move in unison, hooks 314 and 318 will not necessarily be in unison.

Solenoid 306 receives commands from data processing system 300. A more detailed description of data processing 300, and its method of operation will be described below. In summary, data processing system 300 is running a program which controls the pattern weaved by the loom. Data processing system 300 issues commands to electrical interface 302. Electrical interface 302 can then translate these commands into electrical signals to operate solenoid 306. Also attached to electrical interface 302 is sensor 304. Sensor 304 gives feedback to electrical interface 302 so that electrical interface 302 knows the position of the knives at any given time. Sensor 304 communicates to electrical interface 302 when knife 320 is located half-way between the inward position and the outward position. Thus, sensor 304 will detect knife 320 twice during a given cycle, once when the knife is moving from the outward position to the inward position, and once when the knife is moving from the inward position to the outward position. This feedback allows electrical interface 302 to coordinate the movements of solenoid 306 with knives 320 and 316.

Figures 3A, 3B, 3C, 3D:
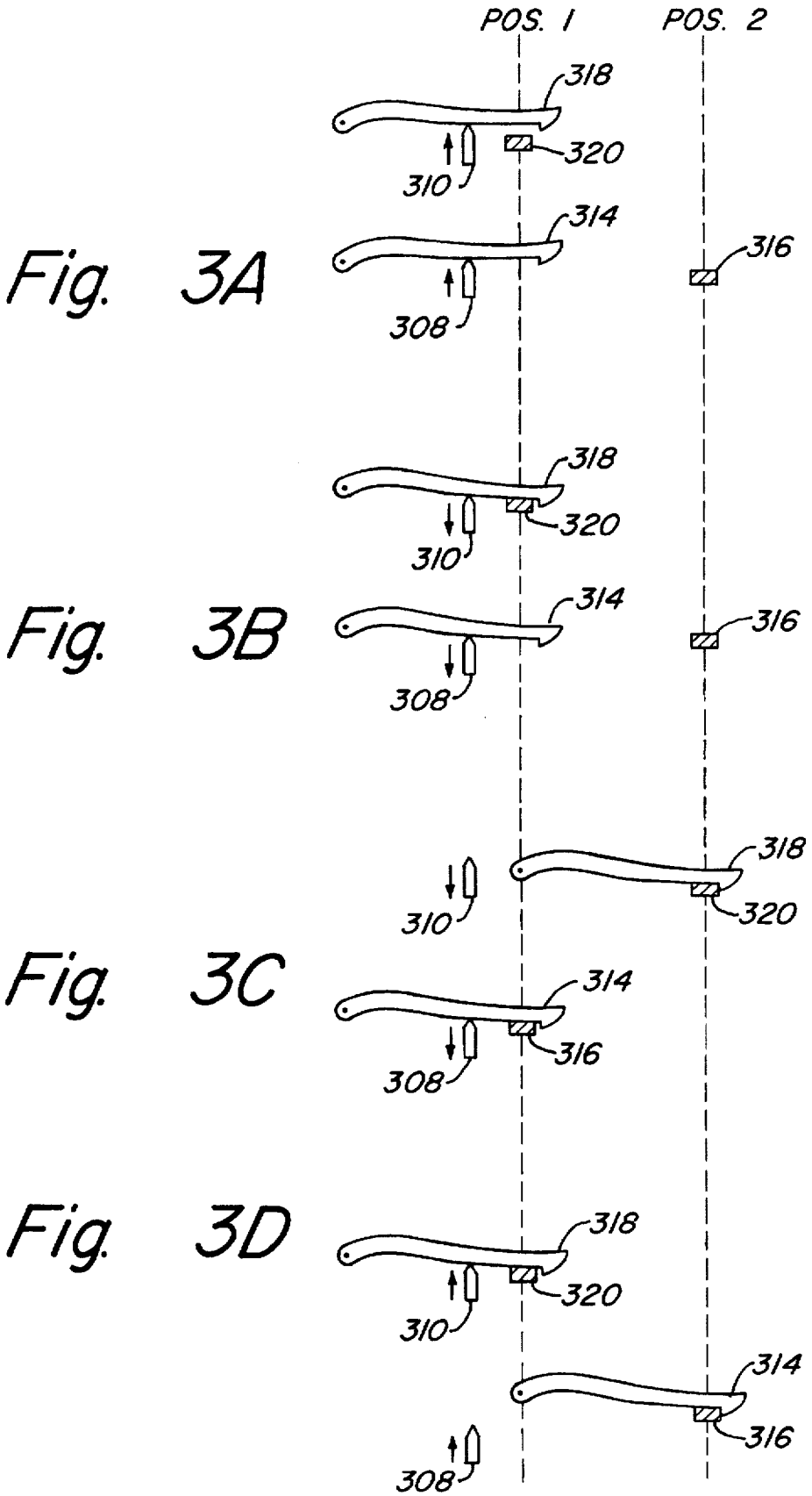
FIG. 3A–3D schematically illustrate the movement of a pair of hooks and knives according to the present invention.

With respect now to FIGS. 3A–3D, there is shown a pair of knives and a pair of hooks according to the present invention. Also shown are schematic representations of fingers 308 and 310. FIGS. 3A–3D illustrate the relative movements of the knives and hooks as they are controlled by a single solenoid. In FIG. 3A, the solenoid which controls the elevation of hooks 318 and 314 has positioned fingers 310 and 308 in the up position (as noted by the arrows). With neither hook presently engaged by a knife, the raising of the fingers raises both of the hooks. The solenoid controlling hooks 318 and 314 is not shown in FIGS. 3A–3D. While in the up position, neither knife 320 or 316 will engage hook 318 or 314 as knives 320 and 316 reciprocate inward and outward.

In FIG. 3B, the solenoid has lowered hooks 318 and 314 by lowering fingers 310 and 308. Hooks 318 and 314 are lowered at the same time, since the solenoid is connected to both of the fingers which control the elevation of the knives. As shown in FIG. 3B, knife 320 has started to engage hook 318. This engagement will allow knife 320 to extend hook 318, thereby raising the frame connected to hook 318. The lowering of hook 314 is inconsequential at this point, as knife 316, being positioned outward, is not in a position to engage hook 314. Thus, in FIG. 3B, the data processing system controlling the activation of the solenoid is concerned only with lowering hook 318 and having it engaged by knife 320. During the transition from FIG. 3B to FIG. 3C, knife 320 will move from its inward position to its outward position, while knife 316 moves from its outward position to its inward position. This movement of the knives will be recorded by sensor 304, shown in FIG. 2. When the sensor detects the transitioning of the knives from one position to the other, it will relay this information to the data processing system. When the data processing system receives notice of this transition, it will then begin to position hook 314 according to the weaving program it is executing.

In FIG. 3C, knife 320 has fully extended hook 318 to its outward position. Also, the data processing system has instructed the solenoid to lower hook 314 so that it will be engaged by knife 316. At this point, both hooks 318 and 314 will be engaged by their associated knives.

In the transition from FIG. 3C to FIG. 3D, the sensor has notified the data processing system of this transition, and the data processing system is now positioning hook 318 in its upward position, as instructed by the weaving program. In this instance, the data processing system has instructed the solenoid to raise hook 318 by raising finger 310, so that it will not be engaged by knife 320. In response to these instructions, the solenoid has moved to raise hook 318. Thus, the solenoid is in the same position in FIG. 3D as it was in FIG. 3A as are fingers 310 and 308. However, since hook 314 has previously been engaged by knife 316, the movement of finger 308 will have no effect on hook 314. This is because the weight of the frame connected to hook 314 will keep it pressed tightly against knife 316. In this matter, a single solenoid may selectively control the position of two hooks.

Figure 4:
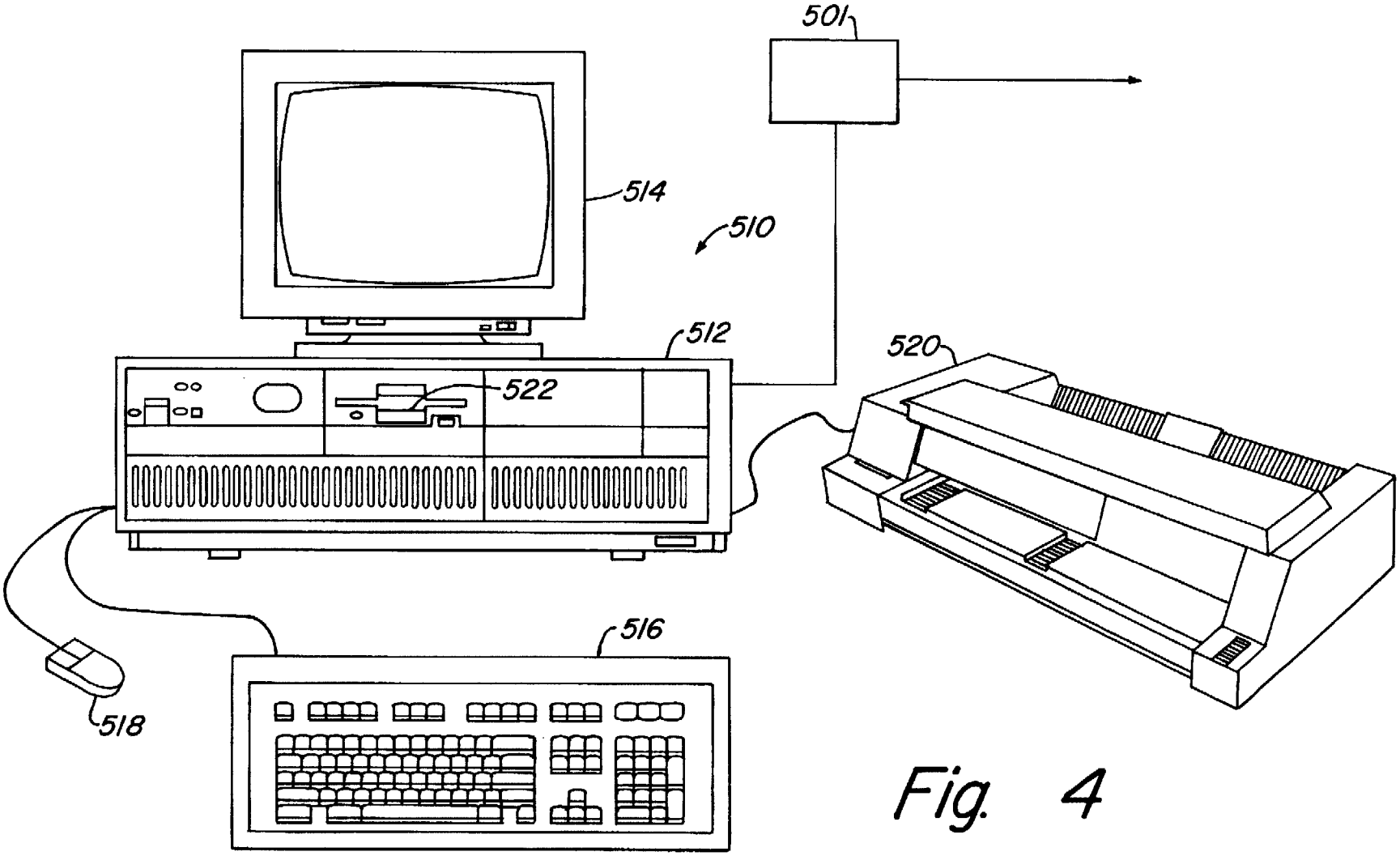
FIG. 4 illustrates a data processing system capable of implementing the present invention.

Referring now to FIG. 4, data processing system 510 is depicted. As shown, data processing system 510 comprises a number of components which are interconnected together. More particularly, system unit 512 is coupled to and can drive an optional monitor 514 (such as a conventional video display). System unit 512 also can be optionally coupled to input devices; such as PC keyboard 516 or mouse 518. An optional output device, such as printer 520, also can be connected system unit 512. Finally, system unit 512 may include one or more mass storage devices such as diskette drive 522.

As will be described below, system unit 512 responds to input devices, such as PC keyboard 516, mouse 518, or local area networking interfaces. Additionally, input/output (I/O) devices, such as floppy diskette drive 522, display 514, printer 520, and local area network communication system are connected to system unit 512 in a manner well known. Of course, those skilled in the art are aware that other conventional components also can be connected to system unit 512 for interaction therewith. In accordance with the present invention, data processing system 510 includes a system processor that is interconnected to a random access memory (RAM), a read only memory (ROM), and a plurality of I/O devices.

In normal use, data processing system 510 can be designed to give independent computing power to a small group of users as a server or a single user. In operation, the system processor functions under an operating system, such as Microsoft's Windows 95, IBM's OS/2 operating system or Apple Computer Corporation's Mac OS, or DOS. OS/2 is a registered trademark of International Business Machines Corporation. "Mac OS" is a registered trademark of Apple Computer Corporation.

Figure 10:
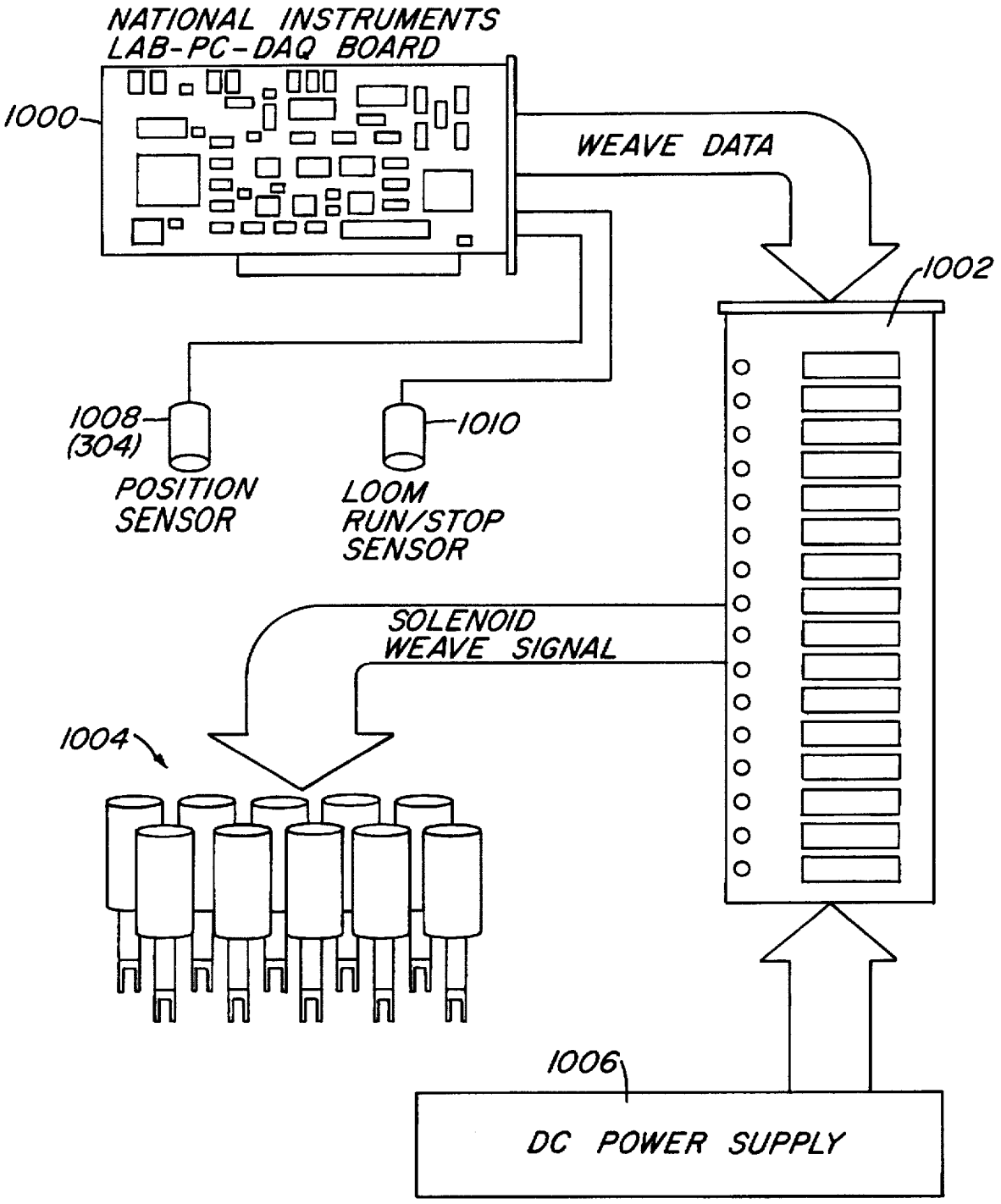
FIG. 10 illustrates the electronic interface that links the data processing system to the dobby head.

Electrical interface 501 is provided to allow data processing system 510 to communicate with the loom shown in FIG. 2. Electrical interface 501 is illustrated in more detail in FIG. 10. With reference now to FIG. 10, data processing system 510 communicates looming information to board 1000. In the preferred embodiment of the present invention, board 1000 is a circuit board manufactured by National Instruments and sold under the tradename "LabPC+Data Acquisition Board." Board 1000 controls the activation the relays on relay board 1002. Relay board 1002 contains 16 solid state relays that control the movements of solenoids 1004. When a relay on relay board 1002 is activated, power from D/C power supply 1006 is connected to a particular solenoid 1004 on the dobby head. Position sensor 1008 (which is also shown as sensor 304 in FIG. 3) and loom RUN/STOP sensor 1010 communicate to board 1000 the position of the loom at all times. RUN/STOP sensor 1010 communicates whether the loom is running or is stopped. In this manner, one can program the pattern to be weaved into data processing system 510, and via electrical interface 501, have this information translated into control signals which control the activation of the actuators attached to the improved dobby.

Figure 5B:
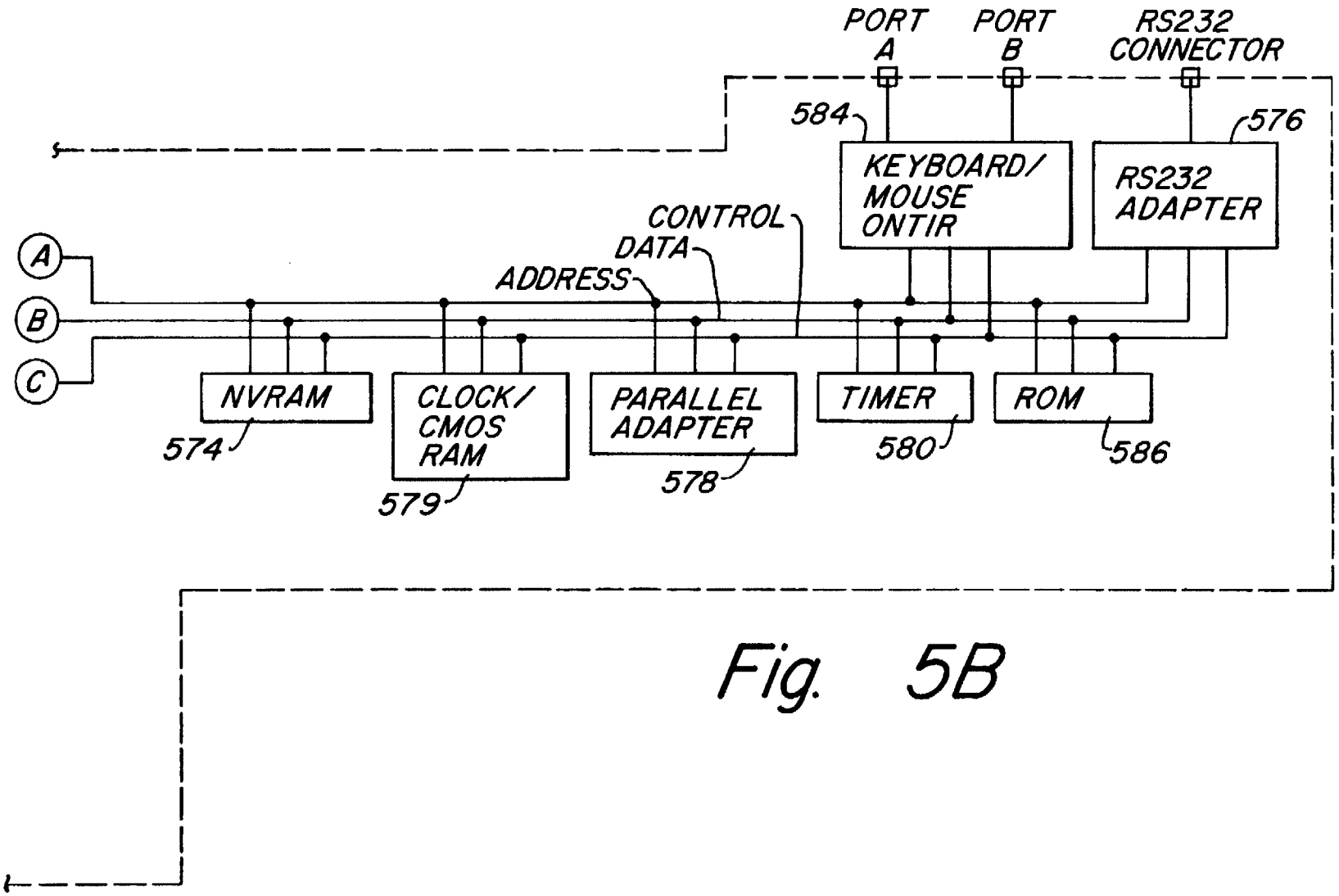
FIG. 5 depicts a block diagram of some of the components of the data processing system shown in FIG. 4.

Prior to relating the above structure to the present invention, a brief summary of the operation of data processing system 510 may merit review. Referring to FIG. 5, there is shown a block diagram of data processing system 510 illustrating the various components of data processing system 510 in accordance with the present invention. FIG. 5 further illustrates components of motherboard 511 and the connection of motherboard 511 to I/O slots **546*a*–546*d* and other hardware of data processing system 510. Connected to motherboard 511 is the system central processing unit (CPU) 526 comprised of a microprocessor which is connected by a high speed CPU local bus 524 through a bus controlled timing unit 538 to a memory control unit 550 which is further connected to a volatile random access memory (RAM) 558**.

CPU local bus 524 (comprising data, address and control components) provides for the connection of CPU 526, an optional math coprocessor 527, a cache controller 528, and a cache memory 530. Also coupled on CPU local bus 524 is a buffer 532. Buffer 532 is itself connected to a slower speed (compared to the CPU local bus) system bus 534, also comprising address, data and control components. System bus 534 extends between buffer 532 and a further buffer 536. System bus 534 is further connected to a bus control and timing unit 538 and a Direct Memory Access (DMA) unit 540. DMA unit 540 is comprised of a central arbitration unit 548 and a EDMA controller 541. Buffer 536 provides an interface between the system bus 534 and an optional feature bus such as Peripheral Component Interconnect (PCI) bus 544. Other bus architectures such as a an ISA bus or NuBus may be employed for PCI bus 544. NuBus is a registered trademark of Apple Computer Corporation. These memory modules represent the system memory of data processing system 510.

A further buffer 566 is coupled between system bus 534 and a motherboard I/O bus 568. Motherboard I/O bus 568 includes address, data, and control components respectively. Coupled along motherboard bus 568 are a variety of I/O adapters and other peripheral components such as display adapter 570 (which is used to drive an optional display 514), a clock 572, nonvolatile RAM 574 (hereinafter referred to as "NVRAM"), a RS232 adapter 576, a parallel adapter 578, a plurality of timers 580, a diskette adapter 582, a PC keyboard/mouse controller 584, and a read only memory (ROM) 586. The ROM 586 includes the system Basic Input/Output (BIOS) which provides the user transparent communications between many I/O devices.

Connected to keyboard/mouse controller 584 are ports A and B. These ports are used to connect a PC keyboard (as opposed to an ASCII terminal) and mouse to the PC system. Coupled to RS232 adapter unit 576 is an RS232 connector. An optional ASCII terminal can be coupled to the system through this connector.

Specifically, data processing system 510 may be implemented utilizing any suitable computer such as the IBM personal computer, Apple Macintosh computer, or Sun workstation, to name a few.

Figure 6:
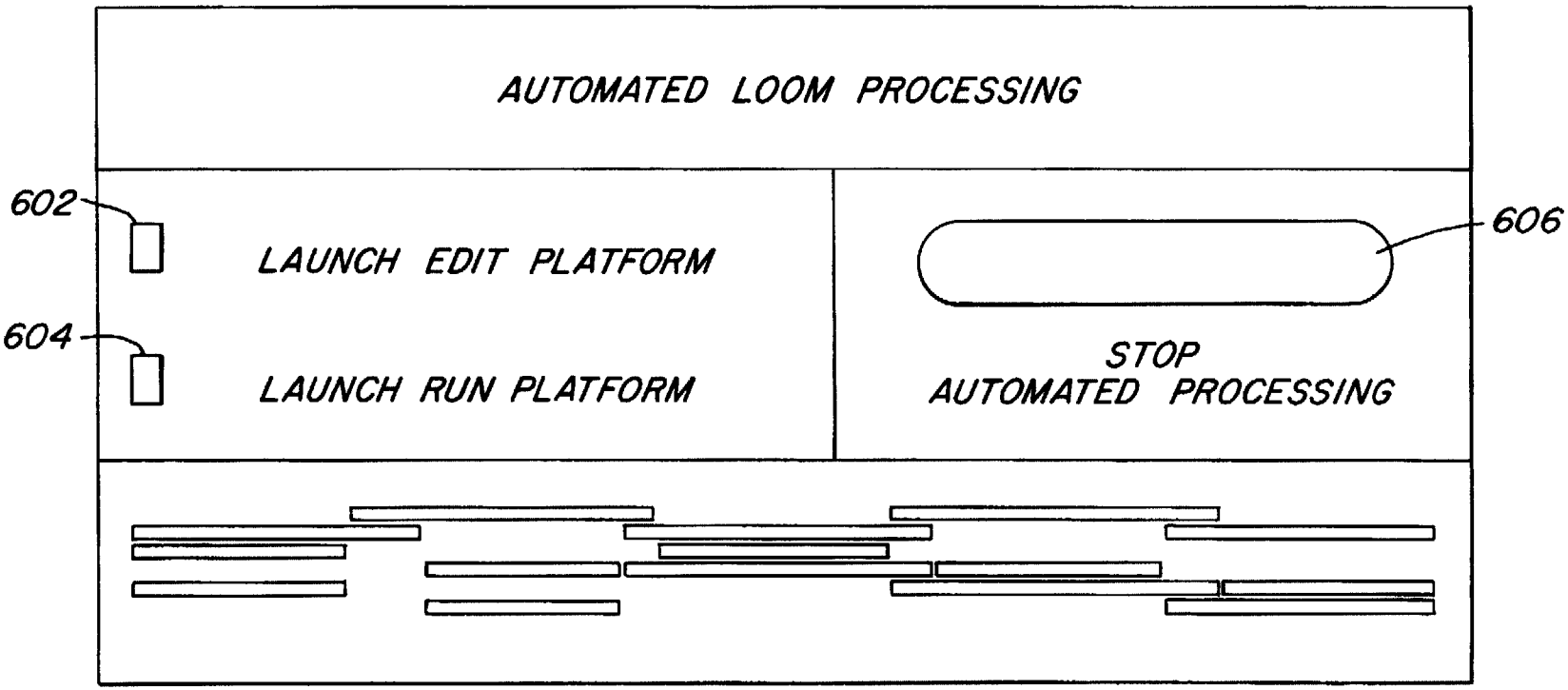
FIG. 6 illustrates the main control screen for the loom control program.

With reference now to FIG. 6, there is depicted the main program screen for the loom control program. This program is capable of being executed on the data processing system described in FIGS. 4 and 5. The initial screen of the loom control program, depicted in FIG. 6, has three main options. First, one can activate edit platform button 602. Activation of edit platform button 602 will cause the loom control program to display the screen shown in FIG. 7. From this screen, a user can enter information and edit previously stored information which will determine the pattern to be weaved by the loom when activated.

Second, there is run platform button 604. Activation of this button will cause the loom control program to display the screen shown in FIG. 8. From this screen, one can have the loom begin weaving using information entered into the screen shown in FIG. 7.

Finally, there is stop main program button 606. Activation of this button will stop all of the weaving processes and will end the loom control program.

Figure 7:
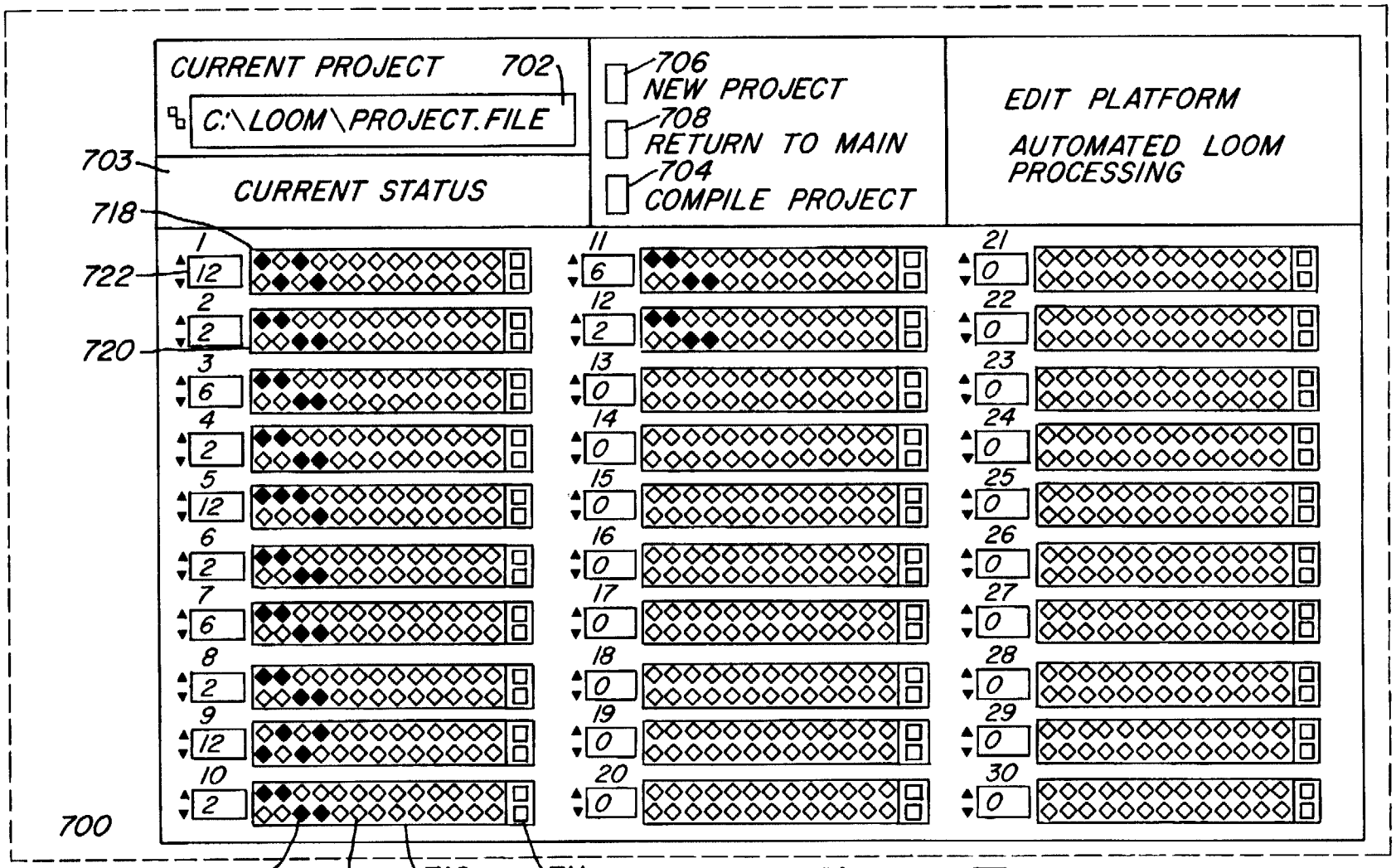
FIG. 7 illustrates the data entry screen for the loom control program.

With reference now to FIG. 7, there is depicted edit platform screen 700. Edit platform screen 700 displays a plurality of peg board representations. These peg boards allow a user to enter information into the loom control program that will determine what pattern is weaved by the loom. Allowing one to enter information into peg board representations is desirable because these peg boards represent a familiar way by which to program the loom. In the past, looms were programed by placing metal studs in the holes of the peg board. Loom platform screen 700 provides a user interface which allows one to select the holes in the displayed peg boards. This selection may be done with a pointing device such as a mouse. This selection process is analogous to placing metal studs in wooden peg boards. Thus, a person accustomed to programming a loom by placing metal studs in a series of peg boards will be quite comfortable with programming the screen as shown in FIG. 7.

When loom platform screen 700 is initially displayed, the user is prompted with a file menu from which the user can choose an existing data file or the user can choose to create a new data file. The name of the file chosen by the user is displayed in current project box 702.

Activation of compile switch 704 saves modifications to the project file without leaving loom platform screen 700 or designating a new project file. This provides for a user to quickly save modifications.

New project switch 706 saves the data that has already been entered under the name listed in current project box 702, then clears the data so that a user may begin to input a new set of data. Upon activating new project switch 706, the user will be prompted to select another data file, or to specify the name of a new data file.

In a manner similar to new project switch 706, return to main switch 708 saves the current data displayed on the screen, and will return the user to the screen as shown in FIG. 6.

Peg board box 710 is provided so that a user may enter information into it, thus specifying the pattern the loom is to weave. Within box 710, there are several holes. These holes are analogous to the holes found in older, wooden peg boards. As can be seen in box 710, some of the holes are colored, an example of which is hole 714. Also, some holes are empty. The colored holes have been selected by a user and correspond to metal studs in an older, wooden peg board. These holes may be selected by a mouse or other pointing device. The holes which are not colored correspond to empty holes in a wooden peg board.

As is evident in FIG. 7, box 710 is only one of many boxes. The holes within the other boxes may be selected in the same manner as the holes in box 710. Thus, by selecting various holes in the boxes shown in FIG. 7, one may program the loom to weave numerous patterns.

The last pegs on each line in box 710 are referred to as packing pegs. An example of a packing peg is packing peg 711 found in box 710. The loom is equipped with a ratchet style mechanical feed to pull the wire cable through the loom. There are occasions when the operator would like to pack the weave by momentarily halting the pull mechanism, which causes the thread to pack tightly. Packing pegs cause a solenoid to disengage the ratchet mechanism, thus deactivating the pull mechanism of the loom.

When the loom control program begins to process the boxes shown in FIG. 7, the loom will examine box 718 first. The program will then send signals to the loom to activate the solenoids which correspond with the selected holes. As described above, the activation of the solenoids ultimately results in the frames associated with the holes being raised.

If a repeat count has been specified in box 722, the program will send the same signals to the loom for the next cycle. The repeat box allows one to repeat the pattern in a given peg board representation without having to program other peg board representations. The program will send the same signals to the loom for the number of times specified in the repeat box.

After the loom control program finishes processing box 718, it goes on to box 720. The program will send signals to the loom as described in box 720, according to the repeat value associated with box 720. The program continues processing the rest of the boxes in FIG. 7 until it reaches the last programmed peg board. At that point, the program will loop back to the first peg board and repeat the cycle.

Figure 8A:
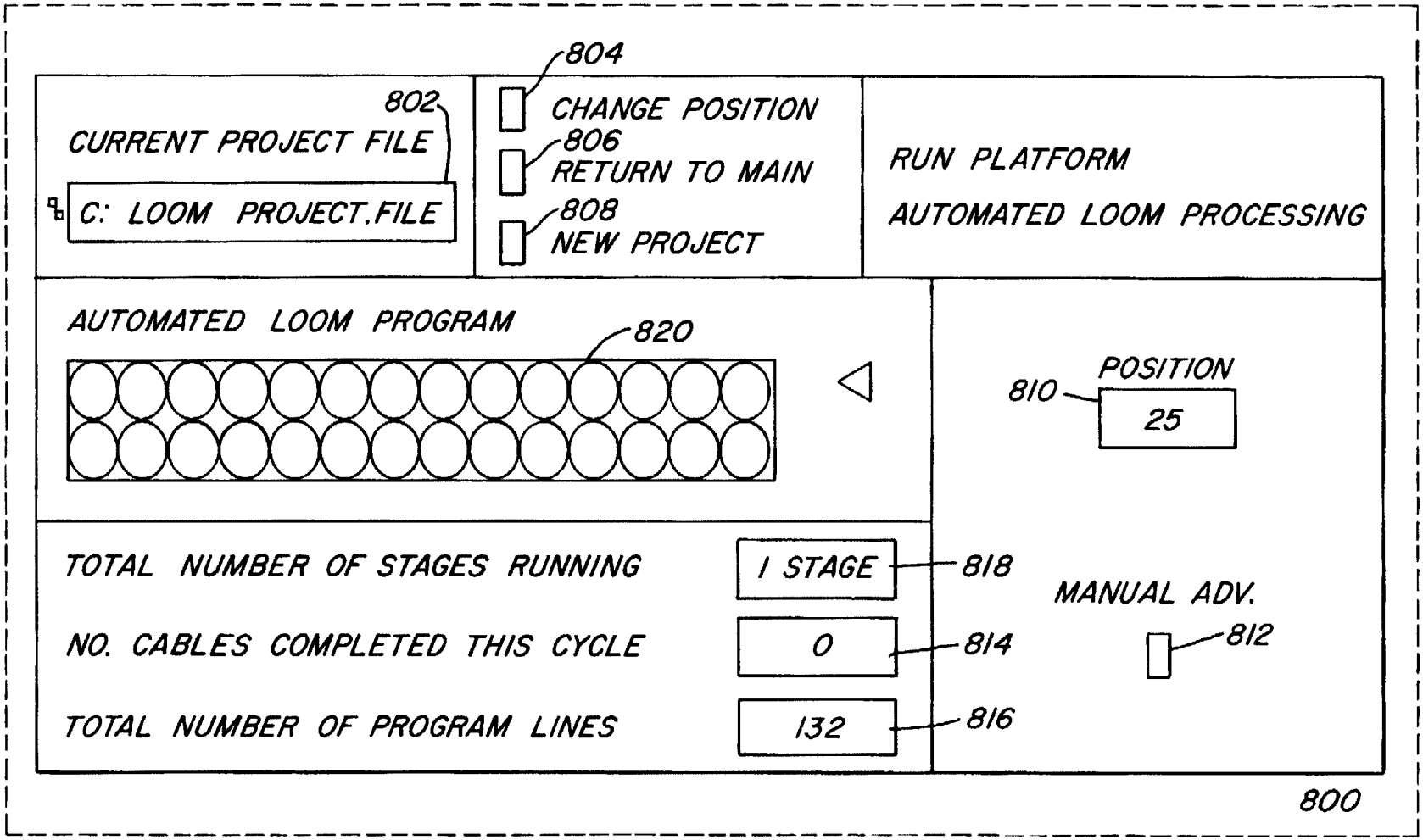
FIGS. 8A and 8B illustrate process control screens for the loom control program.
Figure 8B:
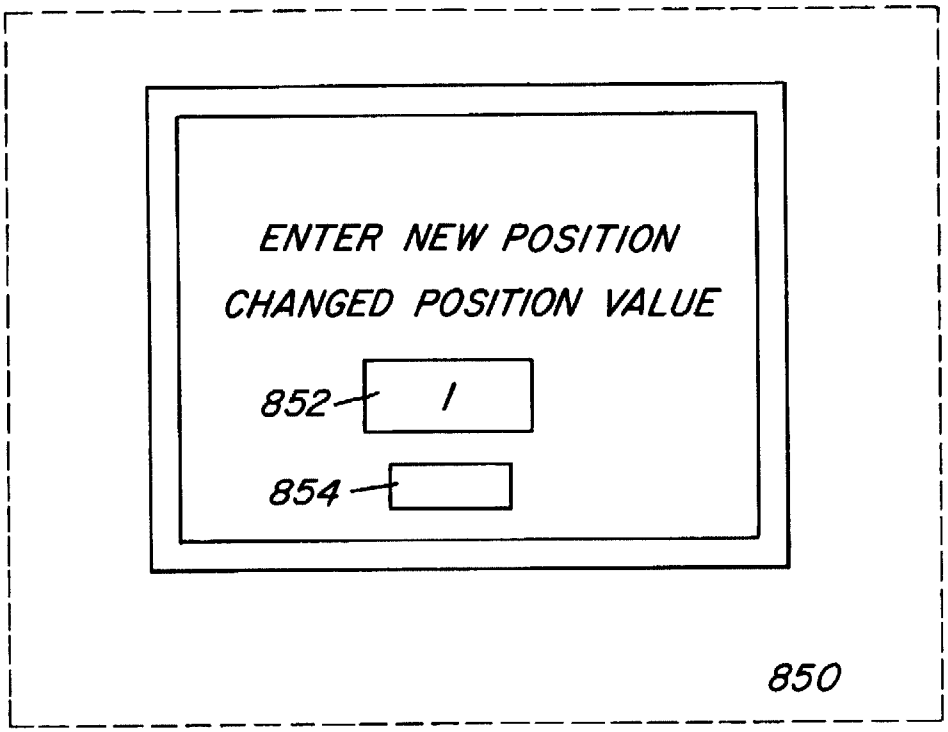

With reference now to FIG. 8, there is depicted run platform screen 800. As was stated above, run platform screen 800 is activated by the selection of run platform button 604, shown in FIG. 6. Upon activation of run platform button 604, a file menu prompts the user to choose the name of an existing file. The selected file name is displayed in current project file window 802. This file was created by entering data into the screen shown in FIG. 7, and saving the data under a file name as specified in current project window 702. At this point, the loom begins to weave a cable and the program continually monitors the status of the loom using position sensor 1008 and loom RUN/STOP sensor 1010. When the operator starts the loom, loom RUN/STOP sensor 1010 signals the program to initiate the required solenoids according to the loaded project file. As the loom weaves, position sensor 1008 allows the program to determine at what time to process the multiple lines of peg board configurations. Automated loom program window 820 displays the current line of the program this is being processed and the next line to be processed. This display is constantly updated when the program is running.

Change position button 804 allows one specify which peg board with which to start the weaving process. For instance, one may want to start the weaving process using peg board #8 instead of the first peg board. When the weaving process reaches the last peg board, it will start again with the first peg board, no matter what value is specified using change position button 804. Activation of change position button 804 displays change position screen 850 shown in FIG. 8B. From change position screen 850, one enters the new position in new position box 852, then activates O.K. button 854 to return to run platform screen 800.

Return to main button 806 stops all weaving process and returns a user to the main program screen as shown FIG. 6. New project button 808 halts the current weaving process and allows one to specify a new current project file. Window 810 indicates which peg board representation is currently being processed.

Total number of stages running window 818 allows one to specify how many cables are to be weaved at a given time. In the preferred embodiment, the loom can weave up to 4 cables at one time. Thus, one can enter a value from 1 to 4 in this window. The number of cables completed this cycle window 814 displays the number of cables which have been completed during the activation of the project file. Total number of stages running window 818 is used to calculate the number of cables completed this cycle. Total number of program bars window 816 displays the total number of individual lines used in the weave data program. Finally, manual advance button 812 allows one to advance the weaving process one half frame at a time. This feature may be useful when trouble-shooting mechanical problems on the loom.

Figure 9:
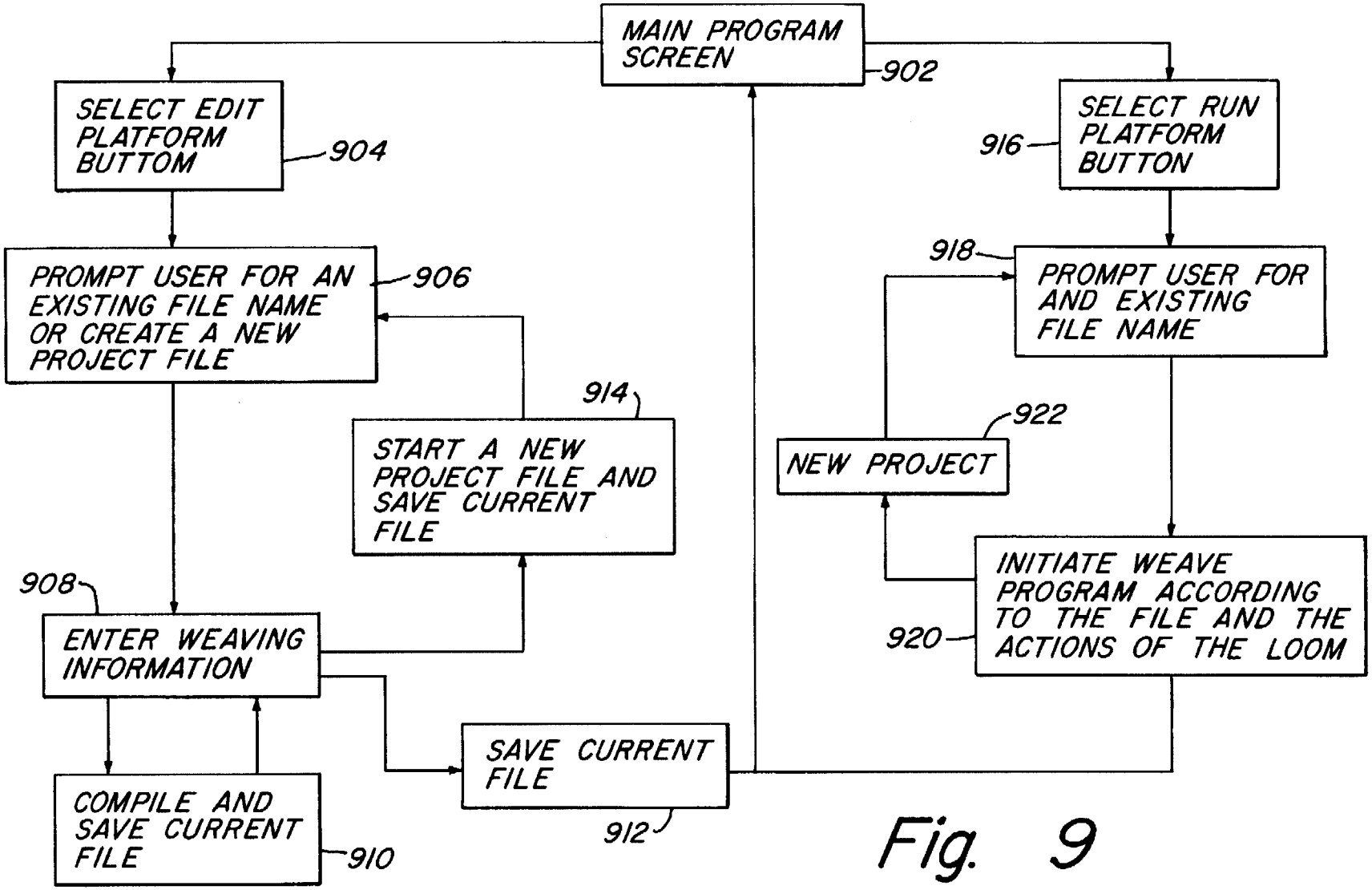
FIG. 9 depicts a process for utilizing the loom control program.

With reference now to FIG. 9, there is depicted a flow chart which illustrates the flow of the loom control program. Initially, one activates the loom control program to display the screen shown in FIG. 6 (902). From this screen, the user first selects the edit platform option to display the screen shown in FIG. 7 (904). When the screen shown in FIG. 7 is displayed, the user is prompted to specify an existing file or given the option to create a new file (906). At this point, one can enter information into the peg board representations, thereby specifying a pattern to be weaved; or one can modify an existing pattern (910). After entering or modifying the data, the file is saved (910, 914, 912), and the user returned to the screen shown in FIG. 6 (912). At the main menu, one selects the run platform button to display the screen shown in FIG. 8 (916). The user is then prompted for the project file name to be loaded (918). After a file name is specified, the weave program is processed based upon the actions of the loom (i.e., the position sensor and the RUN/STOP sensor) and the data contained in the file (920). After the loom finishes weaving, a new file may be specified (922), or the program returns to the main program screen.

The invention described above presents significant advantageous over previous dobbies. Previous dobbies which used solenoids to control the position of hooks, attached solenoids to both the upper hook (hook 318 in FIGS. 2 and 3) and the lower hook (hook 314 in FIGS. 2 and 3). This type of design requires twice as many solenoids as does the present invention, since the present invention requires only one solenoid to control two hooks. Also, designs which require that a solenoid be connected to each hook require that many more modifications be made to the existing dobby, thereby making these modifications very expensive. In contrast, the present invention with a single solenoid connected to a pair of fingers which are located on the outer portion of the dobby makes retrofitting existing dobbies relatively simple. Finally, the amount of space within a dobby to place solenoids is very limited. Thus, dobbies with a solenoid for each hook are difficult to maintain due to the density of the solenoids within the dobby It is important to note that while the method of controlling the improved dobby has been described in the context of a fully functional data processing system, those skilled in the art will appreciate that the mechanisms of the present invention are capable of being distributed in the form of a computer readable medium of instructions in a variety of forms, and that the present invention applies equally regardless of the particular type of signal bearing media used to actually carry out the distribution. Examples of computer readable media include: recordable type media such as floppy disks and CD-ROMs and transmission type media such as digital and analog communication links.

While the invention has been particularly shown and described with reference to a preferred embodiment, it will be understood by those skilled in the art that various changes in form and detail may be made therein without departing from the spirit and scope of the invention.

What is claimed is:

1. A dobby for use with a loom, the dobby having at least one pair of pivotally mounted fingers for movement in a cycle between upper and lower positions, each pair of fingers including a first finger and a second finger, at least one pair of pivotally mounted hooks, each pair of hooks including a first hook and a second hook, with each pair of hooks connected to a single frame and each hook within the pair of hooks being connected to a finger within the pair of fingers for movement between upper and lower positions during the cycle, and a pair of knives having means for reciprocating alternately between inward and outward positions during each half of the cycle for engaging one of the hooks when one of the knives is in an inward position and one of the hooks is in a lower position to pull the hook outward to lift the frame from a lower position to an upper position, the pair of knives including a first knife and a second knife, the dobby comprising:

actuator means connected to both of the fingers in the pair of fingers for moving the pair of fingers in unison between the upper and lower positions;

control means for controlling the movement of the actuator during each half of the cycle; and wherein the actuator means and the control means have during one mode of operation means for placing the pair of fingers in the upper position during both halves of the cycle, thereby placing the pair of hooks in the upper position during both halves of the cycle, causing the frame to remain in the lower position during both halves of the cycle.

2. A dobby for use with a loom, the dobby having at least one pair of pivotally mounted fingers for movement in a cycle between upper and lower positions, each pair of fingers including a first finger and a second finger, at least one pair of pivotally mounted hooks, each pair of hooks including a first hook and a second hook, with each pair of hooks connected to a single frame and each hook within the pair of hooks being connected to a finger within the pair of fingers for movement between upper and lower positions during the cycle, and a pair of knives having means for reciprocating alternately between inward and outward positions during each half of the cycle for engaging one of the hooks when one of the knives is in an inward position and one of the hooks is in a lower position to pull the hook outward to lift the frame from a lower position to an upper position, the pair of knives including a first knife and a second knife, the dobby comprising:

actuator means connected to both of the fingers in the pair of fingers for moving the pair of fingers in unison between the upper and lower positions;

control means for controlling the movement of the actuator during each half of the cycle; and wherein the actuator means and the control means have during one mode of operation means for placing the pair of fingers in the lower position during the first half of the cycle, thereby placing the pair of hooks in the lower position, wherein the first knife engages the first hook thereby raising the frame during the first half of the cycle, and in the one mode of operation the actuator means and the control means have means for keeping the pair of fingers in the lower position during the second half of the cycle, thereby keeping the second hook in the lower position, wherein the second knife engages the second hook thereby keeping the frame raised during the second half of the cycle.

3. A dobby for use with a loom, the dobby having at least one pair of pivotally mounted fingers for movement in a cycle between upper and lower positions, each pair of fingers including a first finger and a second finger, at least one pair of pivotally mounted hooks, each pair of hooks including a first hook and a second hook, with each pair of hooks connected to a single frame and each hook within the pair of hooks being connected to a finger within the pair of fingers for movement between upper and lower positions during the cycle, and a pair of knives having means for reciprocating alternately between inward and outward positions during each half of the cycle for engaging one of the hooks when one of the knives is in an inward position and one of the hooks is in a lower position to pull the hook outward to lift the frame from a lower position to an upper position, the pair of knives including a first knife and a second knife, the dobby comprising:

actuator means connected to both of the fingers in the pair of fingers for moving the pair of fingers in unison between the upper and lower positions;

control means for controlling the movement of the actuator during each half of the cycle; and wherein the actuator means and the control means have during one mode of operation means for placing the pair of fingers in the lower position during the first half of the cycle, thereby placing the pair of hooks in the lower position, wherein the first knife engages the first hook thereby raising the frame during the first half of the cycle, and wherein in the one mode of operation the control means and the actuator means have means for placing the pair of fingers in the upper position during the second half of the cycle, thereby placing the second hook in the upper position, wherein the frame is lowered during the second half of the cycle.

4. A dobby for use with a loom, the dobby having at least one pair of pivotally mounted fingers for movement in a cycle between upper and lower positions, each pair of fingers including a first finger and a second finger, at least one pair of pivotally mounted hooks, each pair of hooks including a first hook and a second hook, with each pair of hooks connected to a single frame and each hook within the pair of hooks being connected to a finger within the pair of fingers for movement between upper and lower positions during the cycle, and a pair of knives having means for reciprocating alternately between inward and outward positions during each half of the cycle for engaging one of the hooks when one of the knives is in an inward position and one of the hooks is in a lower position to pull the hook outward to lift the frame from a lower position to an upper position, the pair of knives including a first knife and a second knife, the dobby comprising:

actuator means connected to both of the fingers in the pair of fingers for moving the pair of fingers in unison between the upper and lower positions;

control means for controlling the movement of the actuator during each half of the cycle; and wherein the actuator means and the control means have during one mode of operation means for placing the pair of fingers in the upper position during the first half of the cycle, thereby placing the pair of hooks in the upper position, wherein the frame remains in the lower position during the first half of the cycle, and wherein the control means and the actuator means have means for placing the pair of fingers in the lower position during the second half of the cycle, thereby placing the first hook and the second hook in the lower position, wherein the second knife engages the second hook thereby raising the frame during the second half of the cycle.

5. The dobby as recited in claim 1, wherein the actuator means is an electric solenoid.

6. A method for weaving wires into flat cables using a loom having a dobby, the dobby having at least one pair of pivotally mounted fingers for movement in a cycle between upper and lower positions, each pair of fingers including a first finger and a second finger, at least one pair of pivotally mounted hooks, each pair of hooks including a first hook and a second hook, with each pair of hooks connected to a single frame and each hook within the pair of hooks being connected to a finger within the pair of fingers for movement between upper and lower positions during the cycle, and a pair of knives reciprocated alternately between inward and outward positions during each half of the cycle for engaging one of the hooks when one of the knives is in an inward position and one of the hooks is in a lower position to pull the hook outward to lift the frame from a lower position to an upper position, the pair of knives including a first knife and a second knife, the method comprising:

connecting an actuator to both fingers in the pair of fingers for moving the fingers in unison between the upper and lower positions;

selectively activating the actuator to move the fingers between the upper and lower positions to control the pattern weaved by the loom; and utilizing the actuator to place the pair of fingers in the upper position during both halves of the cycle, thereby placing the pair of hooks in the upper position during both halves of the cycle, wherein the frame remains in the lower position during both halves of the cycle.

7. A method for weaving wires into flat cables using a loom having a dobby, the dobby having at least one pair of pivotally mounted fingers for movement in a cycle between upper and lower positions, each pair of fingers including a first finger and a second finger, at least one pair of pivotally mounted hooks, each pair of hooks including a first hook and a second hook, with each pair of hooks connected to a single frame and each hook within the pair of hooks being connected to a finger within the pair of fingers for movement between upper and lower positions during the cycle, and a pair of knives reciprocated alternately between inward and outward positions during each half of the cycle for engaging one of the hooks when one of the knives is in an inward position and one of the hooks is in a lower position to pull the hook outward to lift the frame from a lower position to an upper position, the pair of knives including a first knife and a second knife, the method comprising:

connecting an actuator to both fingers in the pair of fingers for moving the fingers in unison between the upper and lower positions;

selectively activating the actuator to move the fingers between the upper and lower positions to control the pattern weaved by the loom;

utilizing the actuator to place the pair fingers in the lower position during the first half of the cycle, thereby placing the pair of hooks in the lower position;

engaging the first hook with the first knife to raise the frame during the first half of the cycle;

utilizing the actuator to keep the pair of fingers in the lower position during the second half of the cycle, thereby keeping the second hook in the lower position; and engaging the second hook with the second knife to keep the frame raised during the second half of the cycle.

8. A method for weaving wires into flat cables using a loom having a dobby, the dobby having at least one pair of pivotally mounted fingers for movement in a cycle between upper and lower positions, each pair of fingers including a first finger and a second finger, at least one pair of pivotally mounted hooks, each pair of hooks including a first hook and a second hook, with each pair of hooks connected to a single frame and each hook within the pair of hooks being connected to a finger within the pair of fingers for movement between upper and lower positions during the cycle, and a pair of knives reciprocated alternately between inward and outward positions during each half of the cycle for engaging one of the hooks when one of the knives is in an inward position and one of the hooks is in a lower position to pull the hook outward to lift the frame from a lower position to an upper position, the pair of knives including a first knife and a second knife, the method comprising:

connecting an actuator to both fingers in the pair of fingers for moving the fingers in unison between the upper and lower positions;

selectively activating the actuator to move the fingers between the upper and lower positions to control the pattern weaved by the loom;

utilizing the actuator to place the pair of fingers in the lower position during the first half of the cycle, thereby placing the pair of hooks in the lower position during the first half of the cycle;

engaging the first hook with the first knife to raise the frame during the first half of the cycle; and utilizing the actuator to place the pair of fingers in the upper position during the second half of the cycle, thereby placing the second hook in the upper position, wherein the frame is lowered during the second half of the cycle.

9. A method for weaving wires into flat cables using a loom having a dobby, the dobby having at least one pair of pivotally mounted fingers for movement in a cycle between upper and lower positions, each pair of fingers including a first finger and a second finger, at least one pair of pivotally mounted hooks, each pair of hooks including a first hook and a second hook, with each pair of hooks connected to a single frame and each hook within the pair of hooks being connected to a finger within the pair of fingers for movement between upper and lower positions during the cycle, and a pair of knives reciprocated alternately between inward and outward positions during each half of the cycle for engaging one of the hooks when one of the knives is in an inward position and one of the hooks is in a lower position to pull the hook outward to lift the frame from a lower position to an upper position, the pair of knives including a first knife and a second knife, the method comprising:

connecting an actuator to both fingers in the pair of fingers for moving the fingers in unison between the upper and lower positions;

selectively activating the actuator to move the fingers between the upper and lower positions to control the pattern weaved by the loom;

utilizing the actuator to place the pair of fingers in the upper position during the first half of the cycle, thereby placing the pair of hooks in the upper position, wherein the frame remains in the lower position during the first half of the cycle;

utilizing the actuator to place the pair of fingers in the lower position during the second half of the cycle, thereby placing the first hook and the second hook in the lower position; and engaging the second hook with the second knife to raise the frame during the second half of the cycle.

* * * * *